United States Patent [19]

Gelhard

[11] 4,290,634

[45] Sep. 22, 1981

[54] ELECTRICALLY AND MANUALLY OPERABLE LOCKING MECHANISM AND DRIVE ARRANGEMENT FOR THE SAME

[75] Inventor: Egon Gelhard, Cologne, Fed. Rep. of Germany

[73] Assignee: Fichtel & Sachs AG, Munich, Fed. Rep. of Germany

[21] Appl. No.: 902,346

[22] Filed: May 3, 1978

Related U.S. Application Data

[63] Continuation-in-part of Ser. No. 865,939, Dec. 30, 1977, which is a continuation-in-part of Ser. No. 739,818, Nov. 8, 1976, abandoned.

[30] Foreign Application Priority Data

May 14, 1977 [DE] Fed. Rep. of Germany ..... 2721970

[51] Int. Cl.[2] ..... E05C 13/10

[52] U.S. Cl. ..... 292/201; 292/336.3; 292/DIG. 22

[58] Field of Search ..... 292/DIG. 22, 1, 144, 292/201, 336.3, 347

[56] References Cited

U.S. PATENT DOCUMENTS

| | | | |
|---|---|---|---|
| 3,081,078 | 3/1963 | Lohr | 292/251 |
| 3,566,703 | 3/1971 | Van Noord | 292/201 X |
| 3,990,531 | 11/1976 | Register | 292/DIG. 22 X |

*Primary Examiner*—Richard E. Moore

*Attorney, Agent, or Firm*—Toren, McGeady and Stanger

[57] ABSTRACT

The door of a motor vehicle may be locked and unlocked by means of an electric motor mounted in the door and accelerating a flywheel. When enough energy is stored in the flywheel, the flywheel is coupled to the lock mechanism. When the lock operation is completed, the flywheel is uncoupled from the lock so that its residual energy need not be absorbed by the lock, and the lock may be operated manually without requiring the flywheel to be turned during manual operation.

19 Claims, 15 Drawing Figures

Fig.1
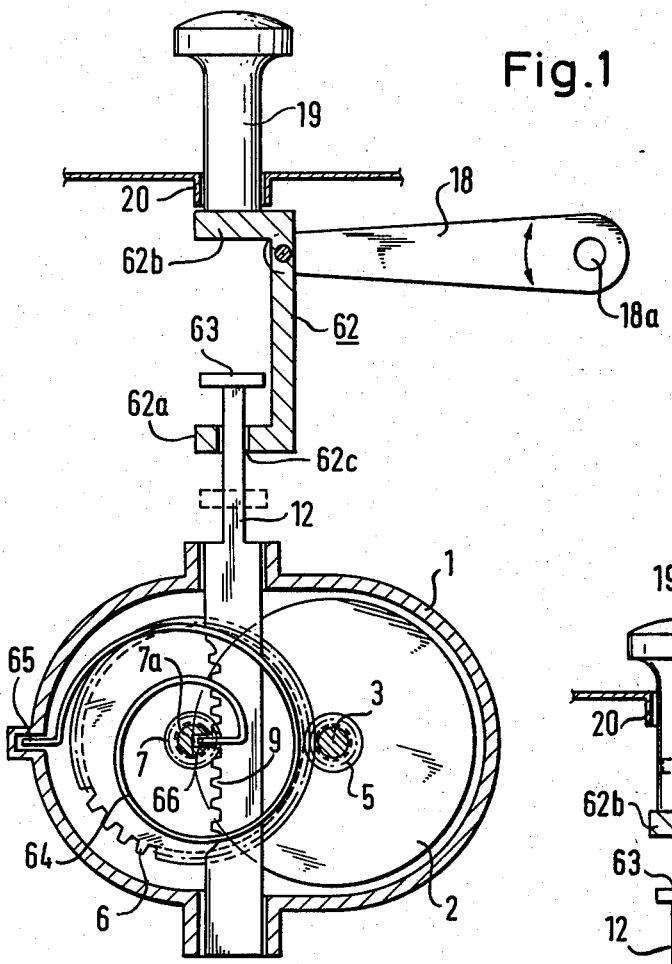
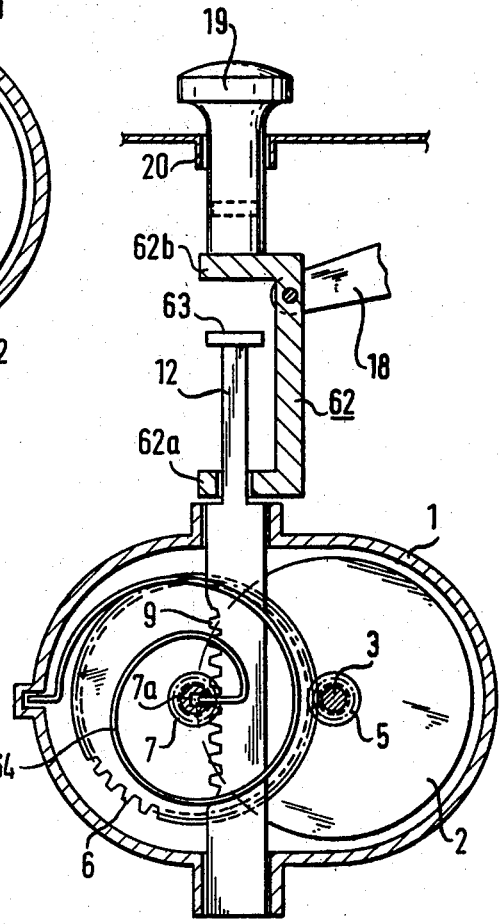
Fig.2

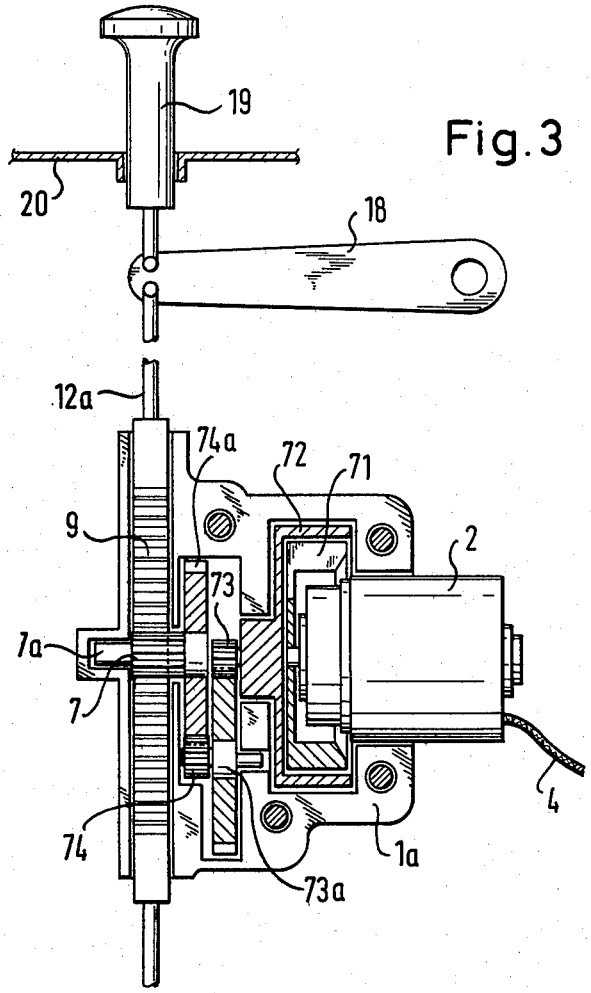
Fig.3
Fig.4
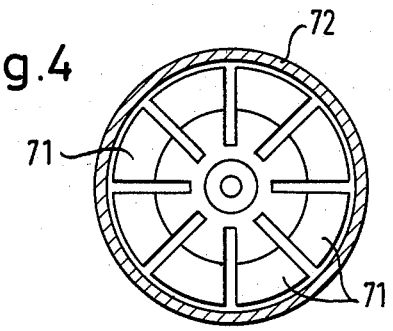

ELECTRICALLY AND MANUALLY OPERABLE LOCKING MECHANISM AND DRIVE ARRANGEMENT FOR THE SAME

This application is a continuation-in-part of my copending application Ser. No. 865,939, filed on Dec. 30, 1977, and itself a continuation-in-part of abandoned application Ser. No. 739,818, filed on Nov. 8, 1976.

In my earlier application, I disclosed an operating mechanism for the doors and similar elements of a motorcar which may be driven by a very small electric motor readily accommodated in the limited space within the door. The motor, when energized, accelerates a flywheel, and the energy stored in the flywheel over a certain period is released quickly for operating the door, for example, for locking or unlocking the door. The force available from the flywheel is much greater than could be supplied by the motor directly.

While devices according to my earlier invention have been used successfully and are simpler and less expensive than similar devices employed prior to my earlier invention, they sometimes require relatively great effort when it is desired to unlock manually a door previously locked by the mechanism of the invention. It has also been found that the locking mechanism and associated devices must be dimensioned to absorb the entire energy stored in the flywheel, including the excess beyond the energy required for performing the desired operation, and may be subject to premature wear if not so dimensioned.

It is a primary object of this invention to relieve the operating mechanism of the lock proper of the excess energy stored in the flywheel. Another object is the provision of a drive arrangement and of a locking mechanism which permit easy manual operation if so desired.

With these and other objects in view, the drive arrangement of this invention has in common with my earlier invention an inertial mass mounted for rotation about an axis through its center of gravity and an electric motor drivingly connected to the mass. A motion transmitting train is operatively interposed between the mass and a movable output member which includes a delay mechanism transmitting motion from the inertial mass to the output member in a response to a predetermined number of revolutions of the mass about its axis. This invention additionally disconnects the output member from the inertial mass after the desired motion of the output member.

In a related aspect, the drive arrangement of the invention includes a motor having a stator and a rotor connected for relative movement in response to electric energizing current. The stator is fixedly mounted on a support, such as the door to be locked, and the rotor is connected for simultaneous rotation to a flywheel whose moment of inertia is greater than that of the rotor. A coupling couples the flywheel to a load in motion transmitting relationship in response to a predetermined number of revolutions of the flywheel after rotation of the flywheel is initiated by energizing the motor. The coupling automatically uncouples the load from the flywheel when the latter decelerates.

A drive arrangement of the type described above may be incorporated in a locking mechanism having an operating element movable between a locking and an unlocking position on a common support with a rotatably mounted flywheel and an electric motor drivingly connected to the wheel. A motion transmitting train operatively interposed between the flywheel and the operating element moves the element between its positions after a predetermined number of flywheel revolutions. When the operating element has performed a desired motion between its two positions, a coupling disconnects it from the flywheel.

Other features, additional objects, and many of the attendant advantages of this invention will readily be appreciated as the same becomes better understood from the following detailed description of preferred embodiments when considered in connection with the appended drawing in which:

FIG. 1 shows a locking mechanism of the invention for a vehicle door in side-elevational section;

FIG. 2 illustrates the device of FIG. 1 in a different operating position;

FIG. 3 shows another locking mechanism of the invention in a view corresponding to that of FIGS. 1 and 2;

FIG. 4 illustrates a centrifugal coupling in the mechanism of FIG. 3 in fragmentary, partly sectional rear elevation;

Figure 5:
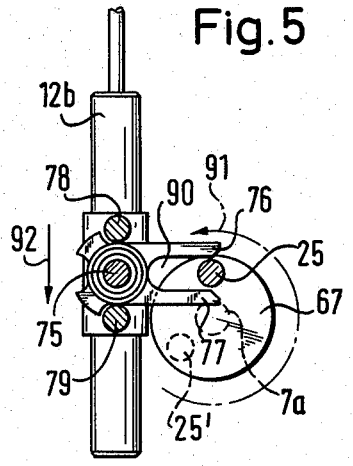
FIGS. 5 to 8 show a further locking mechanism of the invention in fragmentary side elevation and in respective operative positions.

Referring initially to FIG. 1, there is shown only as much of an otherwise conventional automotive passenger car as is needed for an understanding of this invention. A causing 1 is fixedly supported in a hollow door of the car in a manner known in itself and more fully described in my earlier applications. The stator of a reversible electric motor 2 is fixedly mounted in the casing, and the output shaft 3 of the rotor projects beyond the stator in two opposite directions. The projecting end of the shaft 3 obscured in FIG. 1 by the stator of the motor 3 carries a flyweight, not shown, as has been illustrated in FIG. 1 of my copending application. The output shaft 3 is also the input shaft of a speed-reducing transmission mounted in the casing 1 and consisting of a pinion 5 on the shaft 3 which meshes with a spur gear 6 fixedly mounted on a common shaft **7*a* with a pinion 7**.

A bar 12 is guided in an approximately vertical path in the casing 1, and its lower part constitutes a rack whose teeth 9 mesh with the pinion 7 on the output shaft of the speed reducing transmission. The reduced upper end of the bar 12 passes freely through an opening **62*c* in one short, approximately horizontal arm 62*a* of a C-shaped connector 62. The other, upper, short arm 62*b* of the connector 62 is fixedly fastened to a knob 19 of a type and shape commonly used for manual operation of door locks in motorcars. The cylindrical shank of the knob 19 passes through a matching opening in the sheet metal skin 20 of the car door. The free end of a lock operating arm 18 is hingedly fasted to the long, vertical part of the connector 62 and pivots about the axis of a shaft 18*a*, as indicated by a curved double arrow, when the knob 19 is pushed inward of the car door or pulled outward in the usual manner. The pivoting shaft 18*a*** shifts a latch on the door into and out of a recess in the non-illustrated door frame in a conventional manner, not shown.

The free upper end of the bar 12 carries an abutment head 63 which may be shifted into engagement with the connector arms 62*a*, 62*b* by suitably turning the pinion 7. The abutment head 63 is biased toward the illustrated, intermediate position by a spiral spring 64 the outer end 65 of which is secured in a recess of the casing 1 while its inner end is attached to the shaft 7*a* and the pinion 7. In the illustrated relaxed condition of the spring 64, the head 63 is spaced from both horizontal arms 62*a*, 62*b* regardless of the position of the knob 19. The knob and the connected operating arm 18 may thus be shifted freely from the unlocking position of FIG. 1 into the locked position of FIG. 2 and back without interference from the bar 12 and other sections of the motion transmitting train connecting the bar to the electric motor 2 and the obscured flywheel.

When the motor 2 is energized while the mechanism is in the condition seen in FIG. 1 by depressing a push-button switch, not shown, the flywheel is accelerated, but no motion is transmitted to the load represented by the operating arm 18 while the bar 12 descends until the abutment head 63 engages the lower connector arm 62*a*. During the delayed downward movement of the bar 12 jointly with the connector 62 and the knob 19, the arm 18 is pivoted counterclockwise until the head 63 reaches the position near the casing 1 indicated in FIG. 1 in broken lines. During this movement the spring 64 is tensioned and absorbs an increasing amount of the energy stored in the flywheel during the idle stroke of the bar 12. The dimensions of the apparatus and the characteristics of the motor 2 are selected in such a manner that the flywheel is stopped by the spring 64 when the arm 18 reaches its locking position. None of the excess energy in the flywheel is transmitted to the lock, and the bar 12 is returned by the relaxing spring 64 to the position shown in FIG. 1 as soon as the flywheel stops, the motor 2 having been deenergized some time before this condition is reached. The apparatus then assumes the position shown in FIG. 2.

As is evident from FIG. 2, the arm 18 may be returned manually to the unlocking position of FIG. 1 by means of the knob 19 without moving more than the connector 62, the output member of the motion transmitting train between the non-illustrated flywheel on the shaft 3 and the arm 18. The arm 18 may be returned from the position of FIG. 2 to that of FIG. 1 by energizing the motor 2, and thereby raising the head 63 to the position shown in FIG. 2 in broken lines.

In the door locking mechanism partly illustrated in FIG. 3, and conventional as far as not illustrated, a modified casing 1*a* fixedly mounted in the cavity of a motorcar door supports a reversible electric motor 2. The output shaft on the rotor of the motor 2 carries a flywheel 71 of somewhat resilient metal whose moment of inertia relative to the common axis of rotation is much greater than that of the rotor. The heavy, cylindrical, circumferential wall portion of the approximately cup-shaped flywheel 71 and the adjacent part of its radial, relatively thin bottom wall are divided into eight sections by radial slots so that centrifugal force can tilt the circumferential portions radially outward when the flywheel rotates.

When stationary, as shown in FIGS. 3 and 4, the flywheel 71 is spacedly and coaxially enveloped by a friction drum 72 carrying the input pinion 73 of a speed-reducing transmission which also includes a spur gear 73*a* meshing with the pinion 73, a second pinion 74 fixedly connected to the gear 73*a*, and a spur gear 74*a* meshing with the pinion 74 and fixedly mounted on the transmission output shaft 7*a* which also carries a third pinion 7 meshing with teeth 9 of a rack integral with a rod 12*a*. Sections of the rod 12*a* connect the rack to the afore-described arm 18, and the arm to the knob 19.

As long as the motor 2 and the flywheel 71 stand still, the knob 19 may be depressed and lifted manually without turning the flywheel 71 and the rotor in the electric motor 2. The well-lubricated gear transmission offers relatively little resistance to manual operation of the locking mechanism.

When the motor 2 is energized through a cable 4, the flywheel 71 is accelerated, and energy stored in the flywheel is not transmitted to the locking mechanism until the flywheel is expanded by centrifugal forces after a number of revolutions precisely defined by the dimensions and other fixed characteristics of the apparatus. Depending on the direction of rotation of the motor 2, the arm 18 is shifted into the locking or unlocking position in a manner obvious from the description of FIGS. 1 and 2 after the flywheel 71 expands sufficiently for frictional engagement with the drum 72. No new energy being supplied after a while from the deenergized motor 2, and the stored flywheel energy being spent gradually during the lock operation, the flywheel 71 decelerates until it resiliently contracts to the illustrated shape in which it uncouples itself and the motor 2 from the operating arm 18.

The door locking mechanism partly illustrated in FIGS. 5 to 8 combines features of the devices described above with reference to FIGS. 1 to 4. Its motor and flywheel are obscured by a circular disk 67 mounted on the output shaft 7*a* of a speed-reducing transmission similar to that described with reference to FIG. 1. The upper end of a vertical bar 12*b* of stepped cylindrical shape is linked to an operating arm 18 and a knob 19 in the manner shown in FIG. 3, but not again illustrated in FIGS. 5 to 8. An axially elongated crank pin 25 is eccentrically mounted on the disk 67.

The pin 25 is the driven or input member of a coupling that may couple the disk 67 for a portion of one revolution to the bar 12*b*. The driving or output member of the coupling is a fork consisting of two levers 76, 77 fulcrumed on a common pivot pin 75 which is fixedly fastened on the bar 12*b*. A spiral spring connecting the levers 76, 77 and obscured by the lever 77, biases the lever 76 counterclockwise, as viewed in FIG. 5, into abutting engagement of its shorter arm with a pin 79 on the bar 12*b*. The lever 77 is similarly biased in a clockwise direction into engagement with an abutment pin 78 on the bar 12*b*. In their rest positions, the longer arms of the levers 76, 77 are approximately parallel and define therebetween a slot 90 open in a radially outward direction from the pivot pin 75 toward the path of the crank pin 25.

The position of the bar 12*b* relative to the fixed center of rotation of the disk 67 shown in FIG. 5 corresponds to the unlocked position of the connected arm 18, not itself shown in FIG. 5. In the fully drawn condition of the pin 25 seen in FIG. 5, the disk 67 has been moved approximately 270° counterclockwise (arrow 91) from the starting position which is indicated by the position 25' of the pin 25 shown in broken outline, and energy stored in the flywheel causes the rod 12*b* to be pulled down in the direction of the arrow 92 as the pin 25 enters the slots 90 and engages the lever 77. The downward movement of the rod 12*b* continues while the pin 25 travels through an arc of approximately 180°. The pin 25 thereafter is withdrawn from the slot 90, and the rod 12*b* and the connected operating arm 18 are disconnected from the disk 67 and the jointly moving flywheel. The residual energy stored in the flywheel moves the disk 67 and the pin 25 further in the direction of the arrow 91 until friction slows the rotating elements to a halt. During this residual rotation, the pin 25 cannot reach the lever 77. When it strikes the lever 76, the lever is pivoted away from the abutment 79 inward of the slot 90 without causing movement of the bar 12*b* (see FIG. 6). The pin 25 ultimately comes to rest in a position indicated by a broken circle in FIG. 7 in which it leaves the bar 12*b* free to be pulled upward for unlocking the door manually by means of the knob 19.

Figure 7:
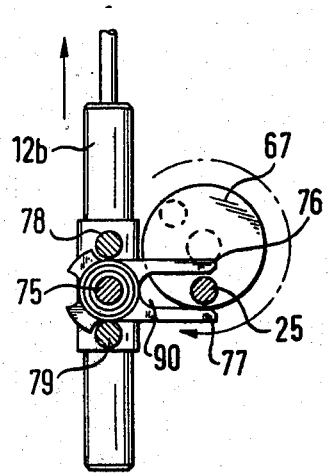
Figure 6:
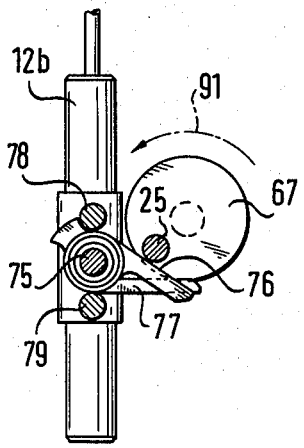
Figure 8:
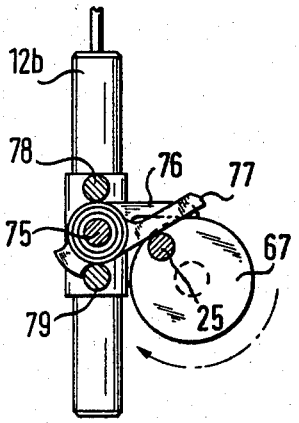

The door may also be unlocked by energizing the obscured motor in a manner to turn the disk 67 clockwise from the rest position of FIG. 7. After the crank pin 25 enters the slot 90 under the conditions shown in FIG. 7, the bar 12*b* is raised while the pin 25 travels through an arc of approximately 180°, and the uncoupled bar 12*b* is not affected when the pin 25 strikes the lever 77 while the residual energy of the flywheel is spent by idle movement of the pin 25, as is evident from FIG. 8.

FIGS. 9 to 12 illustrate only as much of a locking mechanism of the invention as differs from that described above with reference to FIGS. 1 and 3, and enough of common elements to provide an understanding of the differing elements. The output shaft 7*a* of a gear transmission to which a pinion 7 is fastened supports a carrier plate 80 in axially fixed position with a friction fit that permits angular movement of the plate 80 through an arc of approximately 240° defined by abutment of a radial projection 80*a* on the plate 80 against two pins 78*a*, 79*a* fixed on a non-illustrated casing corresponding to the casing 1 in FIG. 1. Three stub shafts 82, fixed on the plate 80 and parallel to the shaft 7*a* carry respective pinions 81, 81', 81''. The pinion 81 meshes with the pinion 7 in all angular positions of the plate 80 and permanently drives the pinions 81', 81'' which project beyond the rim of the plate 80.

Figure 9:
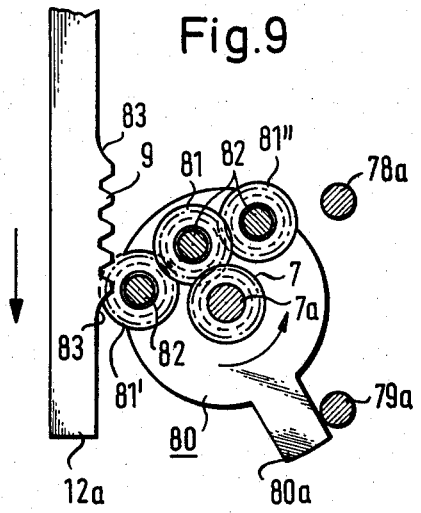
FIGS. 9 to 12 illustrate an additional locking mechanism of the invention in fragmentary, partly sectional side elevation, and in four different operative positions.

A rod 12*a* closely similar to the corresponding element in FIG. 3 is provided with a row of teeth 9 which are engaged by the pinion 81' when the non-illustrated motor and flywheel turn the output shaft 7*a* counterclockwise, as viewed in FIG. 9, until the frictionally entrained carrier plate 80 is stopped by the projection 80*a* engaging the abutment 79*a*. The continued clockwise rotation of the pinions 7 and 81' thereafter causes the rod 12*a* to be pulled down, as indicated by an arrow in FIG. 9, and the non-illustrated operating arm to be moved into its locking position. That position is reached after the pinion 81' has cleared the topmost tooth 9 on the rod 12*a* and enters a recess 83 in the rod in which it may turn freely, as is shown in FIG. 10.

Figure 10:
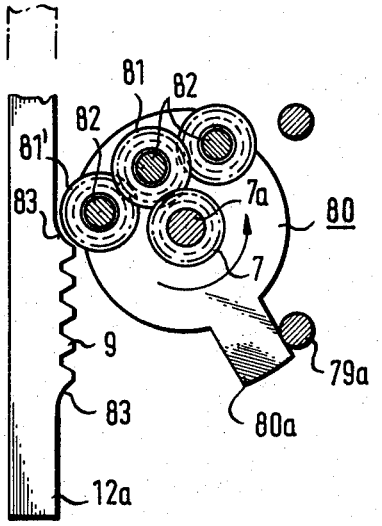

The gear transmission, the flywheel, and the motor may turn freely under the conditions illustrated in FIG. 10 without transmitting forces to the locking devices until the residual energy in the flywheel is spent by friction. The knob 19, not itself seen in FIG. 10, may be used for manually unlocking the door, and the resulting upward movement of the rod 12*a* will merely cause the plate 80 to turn on the shaft 7*a*.

Figure 11:
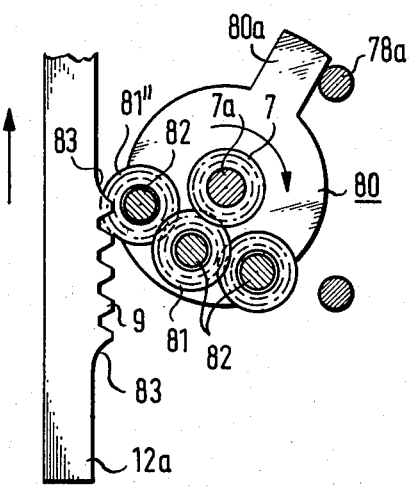
Figure 12:
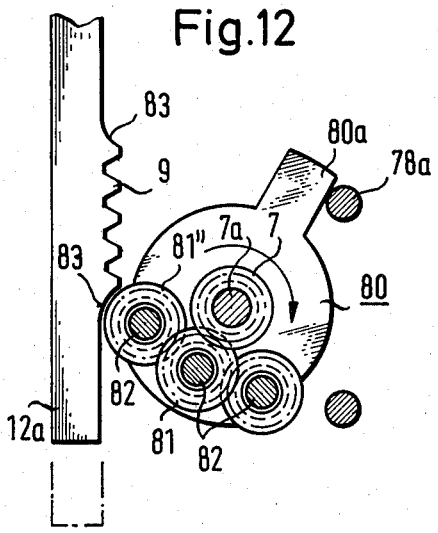

When the associated motor is energized to turn the shaft 7*a* clockwise from the position illustrated in FIG. 10, the plate 80 is moved angularly with the shaft until the projection 80*a* strikes the abutment 78*a*, as is shown in FIG. 11, and the pinion 81'', rotating clockwise, engages the teeth 9 to raise the rod 12*a* into the position seen in FIG. 12 in which the pinion 81'' has cleared the lowermost tooth 9 and has entered a recess 83 of the rod 12*a*, while the non-illustrated arm 18 has reached its unlocking position.

Figure 13:
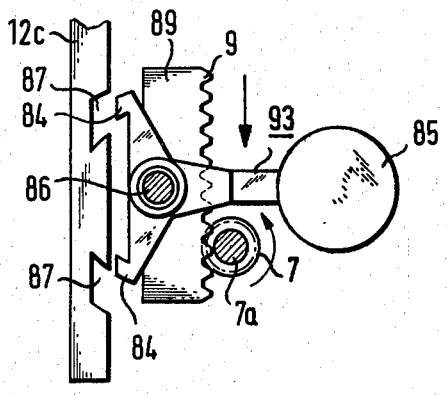
FIG. 13 to 15 are respective fragmentary, side-elevational and partly sectional views of yet another locking mechanism of the invention.
Figure 14:
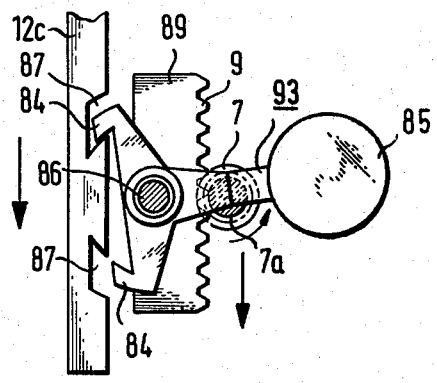
Figure 15:
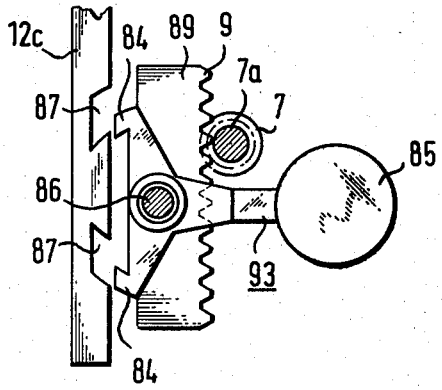

The locking mechanism partly illustrated in FIGS. 13 to 15 includes a bar 12*c* guided in a drive casing (not shown) for up-and-down movement and connected to the operating arm of the door lock and to a manual operating knob as is shown in FIG. 3. A rack 89 is similarly guided in the casing in a path parallel to that of the bar 12*c*. The teeth 9 of the rack 89 mesh with the pinion 7 on the output shaft 7*a* of a speed-reducing gear transmission, not otherwise shown, whose input shaft is driven by an electric motor and a flywheel as described above.

The rack 89 may be coupled to the bar 12*c* by a three-armed rocker 93 mounted on the rack 89 by means of a pivot pin 86. An arm of the rocker 93 remote from the bar 12*c* carries a counterweight 85. The other two arms of the rocker 93 are provided with detents 84 dimensioned for engagement with respective notches 87 in the bar 12*c*.

The rocker 93 is normally balanced in the position illustrated in FIGS. 13 and 15 in which the detents 84 are withdrawn from the notches 87, and the bar 12*c* thus is disconnected from the other elements of the motion-transmitting train connecting the non-illustrated flywheel to the operating arm (not shown) of the lock. This balanced state of the rocker 93 is achieved by a spiral spring (not shown) one end of which is secured to the rack while its other end is attached to the rocker 93. The spring compensates for the force of gravity acting on the counter-weight 85. When the associated motor is energized to turn the pinion 7 counterclockwise, the rack 89 starts moving downward with the pivot pin 86 from the position of FIG. 13. The inertia of the counterweight 85 causes the rocker 93 to tilt counterclockwise so that the upper detent 84 drops into a notch 87 of the bar 12*c*, the notch and detent being undercut in such a manner that the rocker cannot tilt back while the bar 12*c* is moved downward by the engaged detent as seen in FIG. 14. As soon as the rotary speed of the shaft 7*a* decreases sufficiently, the rocker 93 can return to its rest position, as shown in FIG. 15, and the rack 89 thereafter may continue moving to exhaust the residual energy of the flywheel while the bar 12*c* stands still in a position corresponding to the locking position of the associated operating arm.

If the motor is energized to turn the pinion 7 clockwise while all elements have the position shown in FIG. 15 the rack 89 will start moving upward with the pivot pin 86. The inertia of the counterweight 85 will now cause the rocker 93 to tilt clockwise, so that the lower detent 84 drops into the lower notch 87 of the bar 12*c*. In a similar manner as described before the rocker 93 will return to its balanced rest position, as shown in FIG. 13, as soon as the rotary speed of the shaft 7*a* will have sufficiently decreased and the rack 89 thereafter may continue moving to exhaust the residual energy of the flywheel while the bar 12*c* stands still in a position corresponding to the unlocking position of the associated operating arm.

In both cases such decreasing of the rotary speed of the shaft 7*a* is caused by the fact that the motor is only temporarily energized in a manner more fully described in my earlier applications and that the energy stored in the flywheel is gradually consumed after the motor has been deenergized.

From the position seen in FIG. 13 the bar 12*c* may be moved to the position seen in FIG. 15 selectively by energizing the motor or by manually depressing the knob 19, not itself seen in FIG. 13. In the same manner the bar 12*c* may be moved from the position seen in FIG. 15 to the position seen in FIG. 13 by energizing the motor or by manually pulling the knob 19. After the bar 12*c* was moved manually from the position according to FIG. 13 to that according to FIG. 15 while the rack 89 is still in the position seen in FIG. 13, and the bar 12*c* is to be moved thereafter to the position seen in FIG. 13 by means of the motor, the motor first is energized to turn the pinion 7 counterclockwise and move the rack 89 downward to the position seen in FIG. 15. Thereafter energizing of the motor to turn the pinion 7 clockwise causes upward movement of the bar 12*c* in a manner described before. Similarly, if the bar 12*c* was moved manually from the position of FIG. 15 to that of FIG. 13, and is to be moved back to the position seen in FIG. 15 by means of the motor, the motor will have to be energized twice in order first to turn the pinion 7 clockwise and move the rack 89 upward to reach the condition of the mechanism seen in FIG. 13 before energizing the motor for downward movement of the rack 89 with the bar 12*c*. It may be necessary to energize the motor three times if a person is not aware of the fact that power operation requires a double energizing of the motor. If for instance the bar 12*c* is in the position seen in FIG. 13 while the rack 89 is in the position seen in FIG. 15 when the motor is energized to turn the pinion 7 counterclockwise, the rack 89 can only be moved a short distance in a downward direction before being stopped by a non-illustrated or the like stop pin or the like. This will also stop the motor which is of a type not adversely affected by this forcible stopping. The person will realize that the motor did not cause the mechanism to lock, and that the motor must first be energized the normal unlocking direction before the desired locking operation may be performed.

The need for energizing the motor several times by correspondingly operating an associated switch will not normally arise because manual operation after a power operation of the locking mechanism will be followed in most cases by a second manual operation.

It should be understood, of course, that the foregoing disclosure relates only to preferred embodiments, and that it is intended to cover all changes and modifications of the examples herein chosen for the purpose of the disclosure which do not constitute departures from the spirit and scope of the invention set forth in the appended claims.

What is claimed is:

1. A drive arrangement comprising:

(a) an inertial mass having a center of gravity and mounted for rotation about an axis;

(b) an electric motor drivingly connected to said mass for rotating the same about said axis;

(c) a movable output member;

(d) motion transmitting means operatively interposed between said mass and said member, said motion transmitting means including (1) delay means for transmitting motion from said mass to said member after acceleration of said mass about said axis, and (2) disconnecting means for disconnecting said member from said mass after a predetermined motion of said member transmitted to said member by said motion transmitting means.

2. A drive arrangement as set forth in claim 1, wherein said disconnecting means include resilient means operatively connected to said mass for being stressed during said transmitting of motion from said mass to said member, said motion transmitting means including a coupling transmitting motion from said mass to said output member while said motor rotates said mass, and disconnecting said output member from said mass after said motor stops rotating said mass.

3. A drive arrangement comprising:

(a) an electric motor having two parts connected for relative movement in response to electric current energizing said motor;

(b) mounting means fixedly mounting one of said parts on a support;

(1) the other part including an inertial mass having an axis and rotating about said axis relative to said support when said motor is energized, (2) said inertial mass having a first moment of inertia relative to said axis;

(c) a flywheel having a center of gravity;

(d) connecting means connecting said inertial mass to said flywheel for simultaneous rotation of said flywheel, (1) the moment of inertia of said flywheel relative to the axis of rotation thereof being greater than said first moment of inertia;

(e) energizing means for energizing said motor and for thereby initiating rotation of said flywheel;

(f) coupling means for coupling said flywheel to a load in motion transmitting relationship after an acceleration of said flywheel and for uncoupling said load from said flywheel in response to deceleration of said flywheel.

4. A drive arrangement as set forth in claim 3, wherein said coupling means include rotatable first engagement means operatively connected to said load for moving said load when said engagement means are rotated, and second engagement means secured to said flywheel for movement into engagement with said first engagement means in response to centrifugal force when the rotary speed of said flywheel exceeds a predetermined speed, and for movement out of engagement with said first engagement means when the rotary speed of said flywheel falls below said predetermined speed.

5. In a locking mechanism including a support, an operating element mounted on said support for movement between a locking position and an unlocking position, a flywheel rotatably mounted on said support, electric driving means mounted on said support and drivingly connected to said flywheel, and motion transmitting means operatively interposed between said flywheel and said operating element for moving said element between said positions thereof after an acceleration of said flywheel, the improvement in said motion transmitting means which comprises coupling means disconnecting said element from said flywheel in response to a predetermined motion of said element between said positions thereof.

6. In a mechanism as set forth in claim 5, a manually operable actuating member movably mounted on said support and connected to said operating element for simultaneous movement.

7. In a mechanism as set forth in claim 6, said motion transmitting means including first and second abutment members respectively connected to said flywheel and to said operating element for simultaneous movement, and movable relative to each other between two positions of abutting engagement, said abutment members transmitting movement from said flywheel to said operating element in respective opposite directions when in said two positions, and biasing means biasing one of said two members to a position intermediate said positions of engagement, said members being freely movable relative to each other in said intermediate position of said one abutment member.

8. In a mechanism as set forth in claim 7, the other abutment member having two abutment faces spaced from each other, and said one abutment member respectively engaging said faces in said positions of abutting engagement.

9. In a mechanism as set forth in claim 5, wherein said motion transmitting means include centrifugally operated coupling means responsive to a predetermined rotary speed of said flywheel for coupling said flywheel to said operating element, and responsive to deceleration of the coupled flywheel for disengaging said operating element from said flywheel.

10. In a mechanism as set forth in claim 9, said flywheel having an axis of rotation and a circumferential portion movable radially relative to said axis of rotation in response to centrifugal force at a predetermined speed of said flywheel, said coupling means including a friction member rotatable about said axis of rotation in frictional engagement by said circumferential portion at said predetermined speed, and means connecting said friction member to said operating member.

11. In a mechanism as set forth in claim 10, said flywheel consisting essentially of resilient material, said circumferential portion thereof being spaced from said friction member when in the relaxed condition.

12. In a mechanism as set forth in claim 11, said flywheel being formed with a plurality of circumferentially spaced, radial slots, two of said slots bounding said circumferential portion.

13. In a mechanism as set forth in claim 6, said motion transmitting means including a speed reducing transmission having an input shaft drivingly connected to said motor and a rotatable output shaft, said coupling means being operatively interposed between said output shaft and said operating element for moving said operating element during a predetermined angular displacement of said output shaft only and for thereafter releasing said operating element from said output shaft.

14. In a mechanism as set forth in claim 13, said coupling means including a crank pin eccentrically mounted on said output shaft, a motion transmitting member secured to said operating element and carrying two lever members and two abutments respectively associated with said lever members, each lever member being movable on said motion transmitting member toward and away from a position of engagement with the associated abutment, said lever members, when in said positions thereof, defining therebetween a slot open for receiving said crank pin during rotation of said output shaft.

15. In a mechanism as set forth in claim 14, a pivot pin on said motion transmitting member, said levers being pivotally mounted on said pivot pin.

16. In a mechanism as set forth in claim 6, said coupling means including a rack operatively connected to said operating element, a shaft operatively connected to said flywheel for simultaneous rotation, a carrier member frictionally mounted on said shaft for joint angular movement, abutment means limiting the angular movement of said carrier member to two terminal positions spaced apart less than one revolution, two pinions rotatably mounted on said carrier and connected to said shaft for simultaneous rotation in opposite directions, said pinions respectively meshing with said rack in said terminal positions of the carrier.

17. In a mechanism as set forth in claim 16, said rack carrying an elongated row of teeth including two longitudinally terminal teeth, and being formed with a recess longitudinally adjacent each of said terminal teeth, said recesses being dimensioned for receiving said pinions, and for permitting free rotation of the received pinions.

18. In a mechanism as set forth in claim 6, said coupling means including a motion transmitting member guided for linear movement, secured to said operating element and provided with first engagement means, a rack guided in a path parallel to said linear movement, a pinion drivingly connected to said flywheel and meshing with the rack, and second engagement means pivotally mounted on the rack and tilting into engagement with the first engagement means in response to movement of the rack.

19. In a mechanism as set forth in claim 18, said first engagement means comprising two engagement parts spaced in the direction of movement of the motion transmitting member and said second engagement means comprising a three-armed rocker, one arm of said rocker carrying a counterweight, the other two arms of the rocker being provided with detents each dimensioned for engagement with a corresponding part of said first engagement means, the rocker being normally biased into a balanced state in which both detents are out of engagement with the first engagement means.

* * * * *